US007909294B2

(12) United States Patent
Rivas

(10) Patent No.: US 7,909,294 B2
(45) Date of Patent: Mar. 22, 2011

(54) MODULAR RAILROAD SWITCH STAND

(76) Inventor: Arturo A. Ortiz Rivas, Monterrey N.L. (MX)

( * ) Notice: Subject to any disclaimer, the term of this patent is extended or adjusted under 35 U.S.C. 154(b) by 349 days.

(21) Appl. No.: 12/182,603

(22) Filed: Jul. 30, 2008

(65) Prior Publication Data

US 2010/0025546 A1 Feb. 4, 2010

(51) Int. Cl.
*B61L 5/00* (2006.01)

(52) U.S. Cl. ..... 246/410; 246/393

(58) Field of Classification Search ..... 246/393, 246/399, 400, 401, 402, 404, 405, 406, 407, 246/409, 410, 411, 412, 413, 414
See application file for complete search history.

(56) References Cited

U.S. PATENT DOCUMENTS

| | | | | | |
|---|---|---|---|---|---|
| 1,267,998 | A * | 5/1918 | Forth | 70/197 |
| 1,381,732 | A * | 6/1921 | Morrison | 246/413 |
| 1,529,051 | A * | 3/1925 | Wyatt | 246/402 |
| 1,569,694 | A * | 1/1926 | Zipperer | 246/402 |
| 1,783,283 | A * | 12/1930 | Eastburn | 246/286 |
| 1,877,276 | A * | 9/1932 | Davidson | 246/413 |
| 2,082,133 | A * | 6/1937 | Leroy | 246/240 |
| 2,092,828 | A * | 9/1937 | Bone | 246/258 |
| 2,098,796 | A * | 11/1937 | Shirley | 246/400 |
| 2,449,239 | A * | 9/1948 | Magnus | 246/284 |
| 2,669,858 | A * | 2/1954 | Bone | 70/196 |
| 3,427,448 | A * | 2/1969 | Redelman | 246/393 |
| 3,483,368 | A * | 12/1969 | Redelman et al. | 246/393 |
| 6,164,601 | A * | 12/2000 | Scheer et al. | 246/258 |
| 6,168,120 | B1 * | 1/2001 | Pease | 246/405 |
| 7,267,304 | B2 * | 9/2007 | Scheer | 246/410 |
| 2006/0208137 | A1 * | 9/2006 | Scheer | 246/393 |
| 2010/0025546 | A1 * | 2/2010 | Rivas | 246/410 |

* cited by examiner

*Primary Examiner* — J. Allen Shriver, II
*Assistant Examiner* — Jason C Smith
(74) *Attorney, Agent, or Firm* — Bracewell & Giuliani LLP

(57) ABSTRACT

A switch stand for a railroad switch permits the switch to be locked against unauthorized movement of the switch. The switch stand permits trailing operation, even if locked. Passage of the rolling stock through the locked switch is permitted by allowing temporary movement of switch points of the switch when contacted by wheels of the rolling stock. The switch stand can also be unlocked and the position of the switch points changed manually to an alternate position from the normal or set position and then locked against unauthorized movement of the switch.

16 Claims, 7 Drawing Sheets

MODULAR RAILROAD SWITCH STAND

BACKGROUND OF THE INVENTION

1. Field of the Invention

The present invention relates to switch stands for railroad switches, and in particular to switch stands which permit trailing operation of railroad switches.

2. Description of the Related Art

On railroad tracks, railroad switches have been provided to permit trains to transfer from a track or set of rails to another based on the position of a pair of linked tapering rails or points. Railroad switches have also been referred to as turnouts. The switching capability has often been provided through an electric motor driven switch which included a motor-driven throw bar or the like to throw switch points to control the switching of rolling stock. Motor-driven switching worked well for main line and transit operations. However, in rail yard applications additional switching features were needed. It has been common for yard switch operations to include manual operation of the switches by yard personnel.

For accident prevention and safety purposes, it has been common practice to provide switch stands with a mechanism to lock the switch in a desired setting and to indicate that position. However, it has also been desirable that the switches also permit what is known as trailing, where rolling stock such as a car or engine could go through the switch from either of two merging sets of rails onto a single set of rails without having to change the set position of the switch.

In trailing operations, the force of the wheels changed the position of the points to the proper position for the switch point change to occur. If the switch stand was locked, an attempt at trailing would cause damage the switch and stand, and possibly even worse. For this reason, some forms of switch stands were provided with what was known as a semi-automatic capability. The stand was motor-driven and kept in a normal position, but was provided with a separate unit that permitted trailing.

For a switch machine with trailing capability, passage of rolling stock through the switch in the reverse or trailing direction caused the switch to be thrown automatically, that is, without the time delay of a manual switch operation.

So far as is known, two other types of switch stands have been commonly used for railroad switches. One type of switch was manually operable or changeable. Manual switch stands were provided with locks for safety purposes to set and retain the switch in its desired position or setting. However, if trailing operations were attempted through a locked switch, damage resulted as has been mentioned. It was also expensive and time consuming to unlock and then manually change the position of a manual switch temporarily for trailing to occur. However, safety considerations required that the switch be kept locked at all other times at its desired or normal setting.

The other type of switch stand has been the remote controlled or automatic switch stand which allowed the switch stand to be locked from a remote control site. These switch stands were even more costly than semi-automatic stands. Estimated costs of a single remote control switch stand have been about fifteen thousand dollars each. With the number of switch stands present in a railroad system, the capital investment costs can be seen to be considerable.

SUMMARY OF INVENTION

Briefly, the present invention provides a new and improved switch stand for operating a railroad switch in a trailing operation moving points of the railroad switch from a set position to permit passage of railroad rolling stock through the switch in the trailing operation. The switch stand includes a housing mounted adjacent the railroad switch, and a shaft mounted in the housing. The shaft is connected to the railroad switch and is movable from a normal position and rotatable in response to movement of the railroad switch when contacted by a wheel of the rolling stock in a trailing operation. A contact block member of the switch stand is mounted in the housing with the shaft. The contact block member moves along a longitudinal axis of the shaft, but is restrained against rotational movement with respect to the shaft and housing as the shaft rotates.

A roller guide member of the switch stand is rotatably mounted on the contact block member. A plate member fixedly mountable with the shaft for rotational movement and having a camming surface along a portion thereof engaging the roller guide causes rotational movement of the shaft with respect to the housing in response to movement of the railroad switch when contacted by a wheel of the rolling stock in a trailing operation.

A resilient member urges the camming roller against the guide shaft of the plate member to return the plate member to a position causing the switch to return to the normal position on removal of contact of the rolling stock wheel against the switch. A top cap is mounted with the shaft for rotational movement therewith and has control detents formed in it.

A control lever fixedly mounted with the shaft is selectively movable into engagement with the top cap in one of the control detents to interconnect the top cap and the shaft for rotational movement during trailing operation of the switch stand.

The present invention thus provides a modular semi automatic high switch stand for a railroad turnout in which the base is a removable piece bolted to a main body of the switch stand. Thus, when the base is damaged or broken it may be changed easily and quickly. Further in the event that it may be necessary for the base to be removed for some reason, the main body remains mounted in place on the ties. The modular switch stand has a pin eye or socket that has the exact radius to meet the throw specification that must be one and the same for the two switch points of a turnout. The pin eye is made to match with an adjusting rod in order to properly adjust the switch points.

Figure 1:
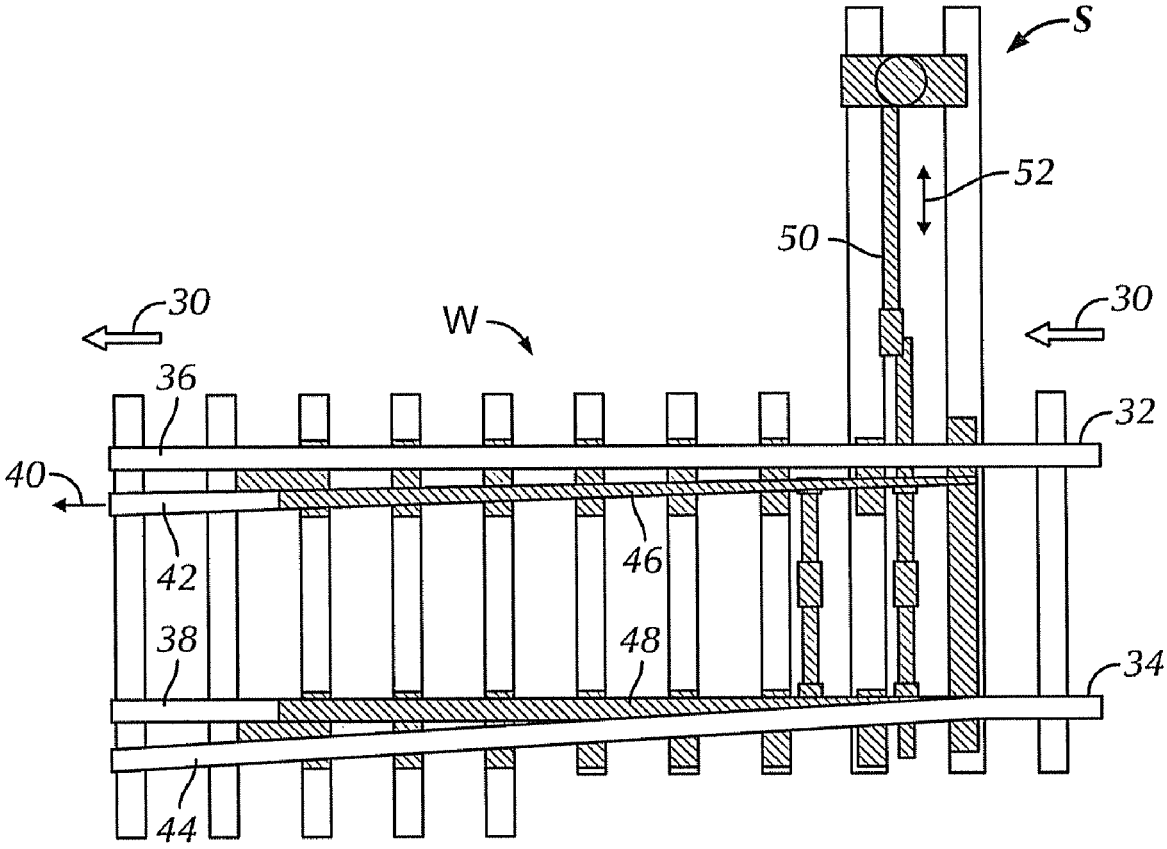
FIG. 1 is a schematic view of a railroad track switch with a switch stand according to the present invention.

To better understand the invention, a detailed description of certain embodiments is shown in the drawings for illustrative purposes but not as limitations, as further described herein. In certain of the Figures, components are illustrated in somewhat enlarged views from other Figures so that structural features thereof may be more readily seen.

DETAILED DESCRIPTION OF THE PREFERRED EMBODIMENTS

In the drawings, the letter S designates generally a switch stand according to the present invention. The switch W is shown in FIG. 1 in what is known as a set position. In the set position, the switch W allows railroad rolling stock to move as indicated by an arrow 30 from rails 32 and 34 onto rails 36 and 38 of what is known as the straight track. The switch W can be moved manually using the switch stand S to an alternate position and locked to allow movement, as indicated by an arrow 40, of rolling stock from rails 32 and 34 onto rails 42 and 44 of what is known as diverging track. In the alternate position, switch point 46 is in engagement with rail 32 and switch point 48 is spaced from the rail 44 to guide the rolling stock wheels from rails 32 and 34 onto rails 42 and 44, respectively.

As will be set forth below, the switch stand S permits operating the railroad switch W in a trailing operation to allow rolling stock to move from the diverging track onto rails 32 and 34 when the switch W is in the set position shown in FIG. 1. In the trailing operation, switch points 46 and 48 of the railroad switch W move from the set position (FIG. 1), even though the switch is locked in that position, to permit passage of railroad rolling stock through the switch W.

Figure 2:
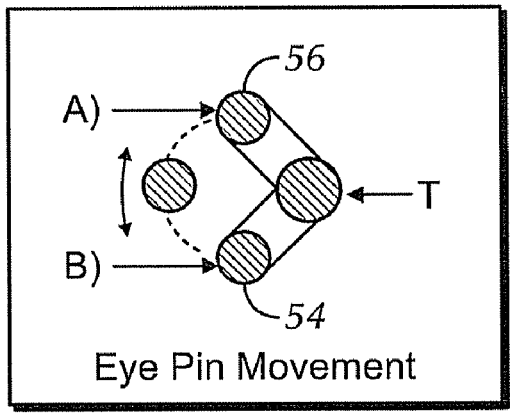
FIG. 2 is a schematic view of the operation of the switch and portions of the switch stand of FIG. 1.

The switch stand S of the present invention is shown schematically in FIG. 1, while structural features are shown in other figures of the drawings. As shown in FIG. 1, the switch stand S is connected to the switch points 46 and 48 of the switch W by a linkage including a connecting rod 50. The connecting rod 50 moves along its longitudinal axis as indicated at 52 to adjust the position of the switch points 46 and 48. The connecting rod 50 is connected in the conventional manner to a conventional eye pin which is mounted on a socket 60 located at a lower end 62 of a shaft T. As the connecting rod 50 moves longitudinally and the position of the switch points 46 and 48 change, the shaft T rotates, as indicated schematically in FIG. 2, between positions 54 and 56 based on the limits of longitudinal movement of the connecting rod 50. As mentioned above, the switch W permits trailing operations when wheels of rolling stock contact the switch points in transitioning from rails 42 and 44 (FIG. 1) to rails 32 and 34. The shaft T is also rotatable through movement of the connecting rod 50 in response to movement of the switch points 46 and 48 of railroad switch W when contacted by wheels of the rolling stock in the trailing operation.

The shaft T is preferably a heat treated steel having the sleeve or socket 60 in the lower portion 62 for connection in the conventional manner to the pin eye of the known type. As has been set forth, the pin eye is connected by the connecting rod 50 to the switch W. If desired, the sleeve 60 may be provided with a groove or slot with an inner flat side to provide a positional reference to maintain proper distance or spacing between the rotational axis of the shaft T and the rotational connection of the pin eye. This is done to provide correct spacing and rotational movement of the shaft T and the end of the connecting rod 50, in order to have the correct throw in the switch points 46 and 48.

The shaft T of the switch stand S of the present invention is located in a housing H mounted adjacent the railroad switch W, extending upwardly through ports or passages 62 and 64 formed in interior body walls 66 and 68 of the housing H. The shaft T is freely rotatable about its longitudinal axis with respect to the housing H, and bearings 70 and 72 are mounted in ports 62 and 64 to provide for freedom of such rotational movement. The shaft T in addition has reduced friction against rotation when the switch stand S is operated by hand. The bearings 70 and 72 reduce such friction against rotation so that the force required to be applied by an operator during manual operation is reduced. The shaft T is connected to the railroad switch W and is movable from a normal position as indicated at 34 (FIG. 2) with the switch W in the set position (FIG. 1).

Figure 6:
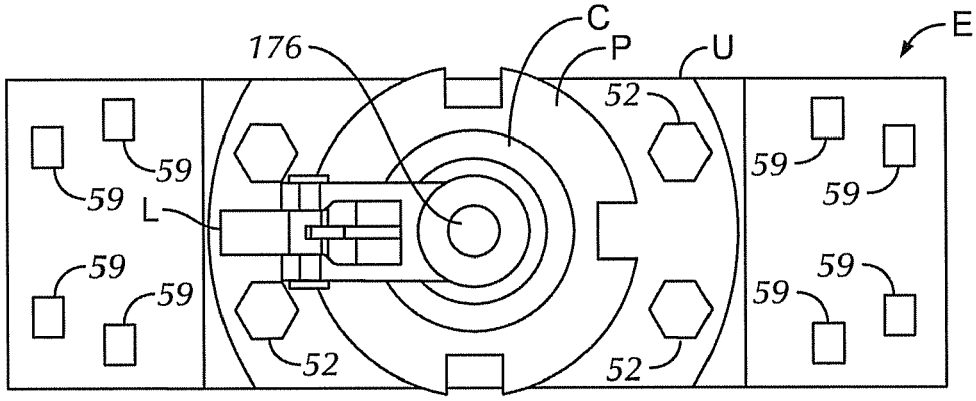
FIG. 6 is a view taken along the lines 6-6 of FIG. 3.

The housing H according to the present invention is formed of two component members or parts: an upper housing structure U which contains the operating mechanism of the switch stand S; and a base or mounting plate E for connecting the upper housing structure U to railroad crossties or other support structure. With the operating mechanism contained in the housing H, the switch stand of the present invention is modular. The upper housing structure U is connected by bolts 52 (FIG. 6) or other suitable connectors to the base plate E, and the base plate is connected by spikes, bolts or the like as indicated at 54 to the railroad crossties or other support structure. The housing H can thus be disconnected into two separate housing components. In service, lower portions of switch stands have often been damaged by throw bars, hammers or the like during construction, maintenance or other activities during everyday usage. On such occasions, with a unitary housing the complete switch stand required replacement. With the present invention, it is only required to remove and replace the base plate E in the event of such damage. The structure and mechanisms of the upper housing H need not be replaced.

Figure 3:
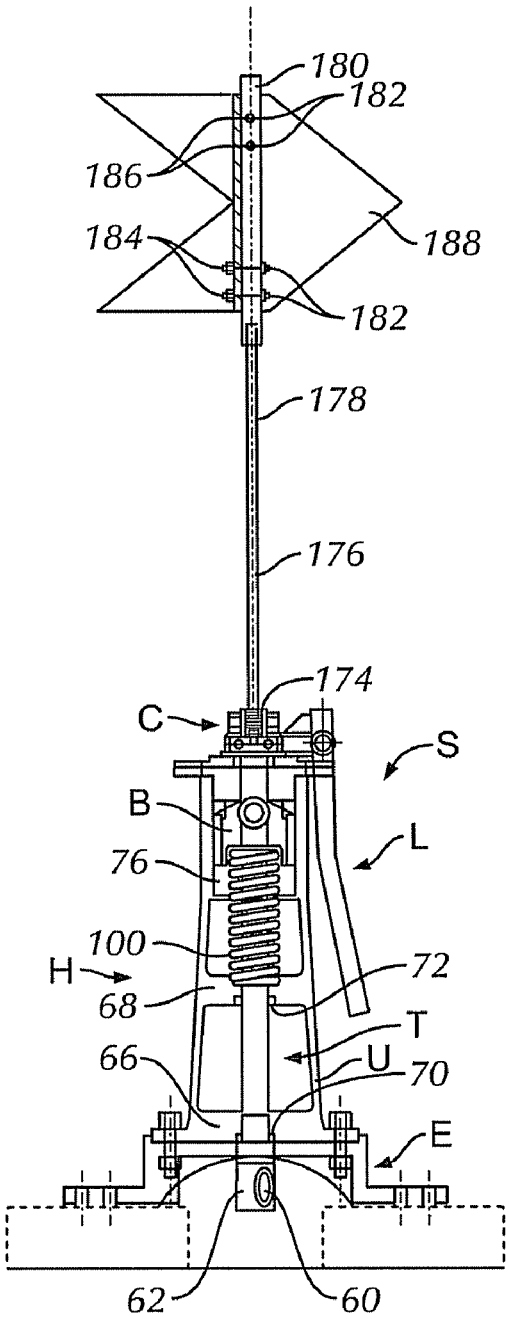
FIG. 3 is a front elevation view of a switch stand according to the present invention.
Figure 4:
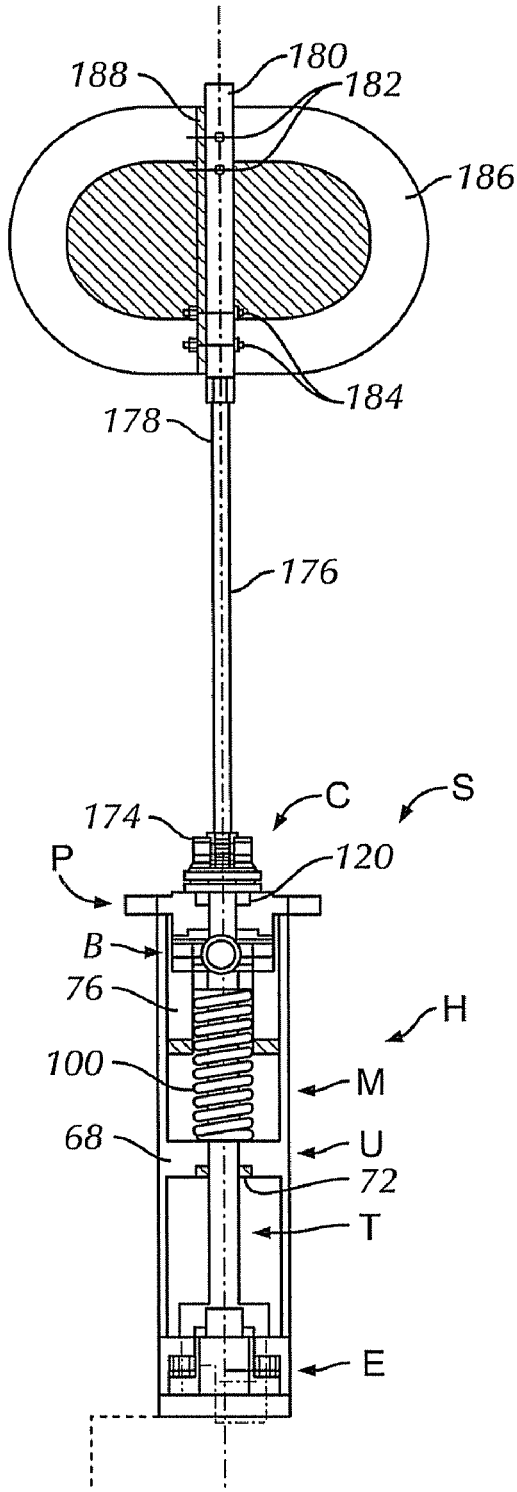
FIG. 4 is a side elevation view of the switch stand of FIG. 3.
Figure 5:
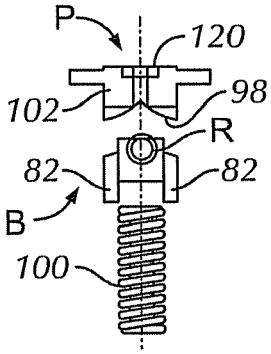
FIG. 5 is an exploded view of portions of the switch stand of FIGS. 3 and 4.

The modular switch stand S shown in FIGS. 3 and 4 according to the present invention is what can be regarded as a high or tall stand. It should be understood, however, that the modular switch stand according to the present invention can take the form of a low stand (FIG. 22), as will be set forth.

Figure 9:
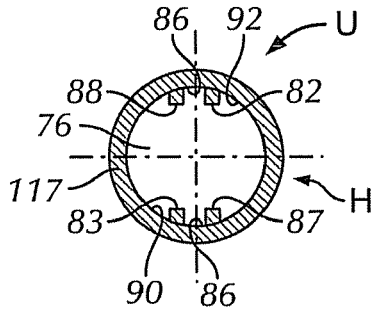
FIG. 9 is a cross-sectional view taken along the lines 9-9 of FIG. 8.
Figure 7:
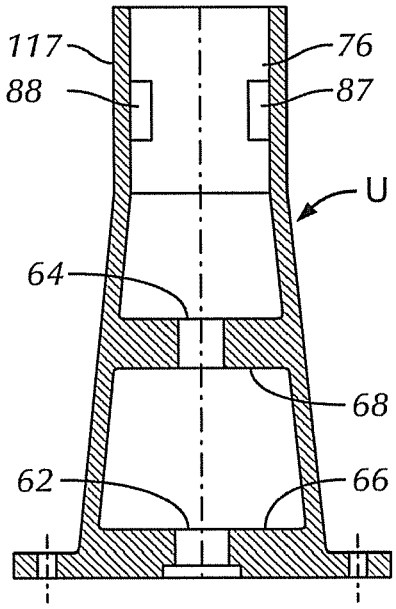
FIGS. 7 and 8 are vertical cross-sectional views of a housing of the switch stand of FIG. 3.
Figure 8:
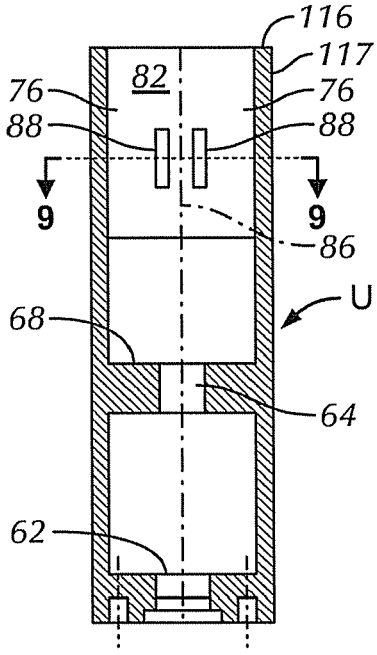
Figure 10:
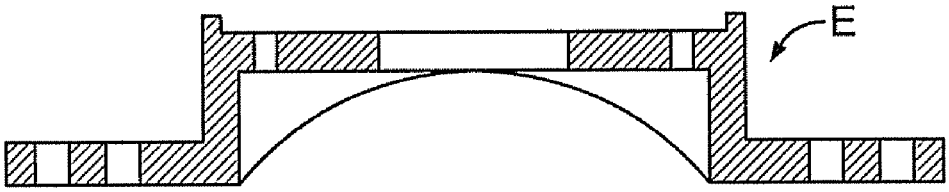
FIG. 10 is a vertical cross-sectional view of a base of the switch stand of FIG. 3.

A contact block member B (FIGS. 5, 12, 13 and 14) of the switch stand S is mounted with the shaft T in an upper chamber 76 of the housing H above the wall 68. The contact block member B has a central sleeve or opening 80 through which the shaft T passes. The sleeve 80 is sized so that the shaft T freely moves for rotation along its longitudinal axis in the contact block member B. The contact block member B has outwardly extending guide finger or tongue members 82 formed along an outer side wall 84 which are fitted into slots 86 (FIGS. 7, 8 and 9) formed between guide channels 87 and 88 formed on each of opposed inner side walls 90 and 92 in the upper chamber 76 of the housing H. The contact block member B thus is capable of movement within the housing H along the longitudinal axis of the shaft T. The contact block member B also permits rotation of the shaft T with respect to the housing H. However, the contact block member B is restrained by the fingers 82 in the slots 86 against rotational movement in conjunction with the shaft T as the shaft T rotates.

The switch stand S of the present invention includes one or more roller guide members R (FIGS. 12, 13 and 14) which are mounted for rotational movement on shafts 96 formed on the contact block member B. The shafts 96 are formed extending outwardly (FIG. 12) from outer side wall 84 at positions peripherally spaced from finger members 82. The roller guide members R are urged upwardly by a resilient force-exerting member M (FIG. 3, 4 and 5), typically a coiled spring 100, into contact with a curved camming surface 98 formed on a lower circumferential portion or skirt 102 of a plate member P.

The spring 100 is positioned in the chamber 76 of the housing H between the wall 68 and a lower surface 104 within a pocket 106 formed in a lower portion of the contact block member B exerting a force on the contact block member urging the roller guide members R into engagement with the camming surface 98. The size and contouring of the camming surface 98*a* are established so that the roller guide members R can allow the plate member P to travel over the roller members R from an upper or rest position 98*a* slightly less than one-eighth turn or 45° to a location 98*b* or 98*c* as the case may be.

Such movement occurs in response to movement of the shaft T due to forces exerted by the wheels of the rolling stock on the switch points 46 and 48 during a trailing operation. On removal of such wheel forces after passage through the switch W, the force from the spring 100 causes plate member P to travel along its lower surface 98 over the roller members R and return to the rest position 98*a* on the surface 98. In the absence of such wheel forces, spring 100 urges the switch point 48 into firm engagement with the side rail 34.

Figure 15:
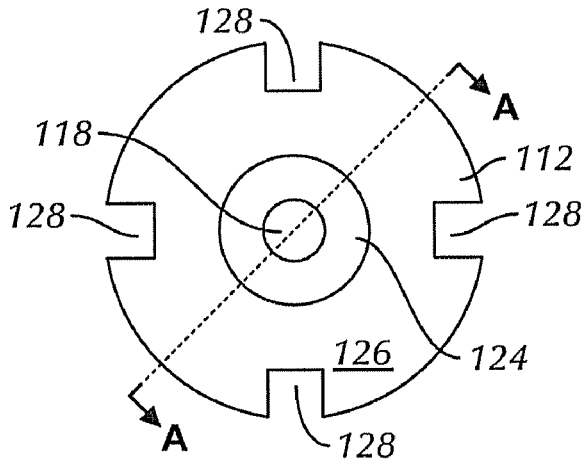
FIG. 15 is a plan view of a plate member of the switch stand of FIG. 3.
Figure 16:
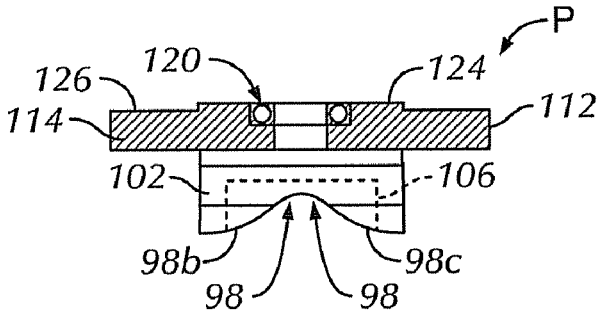
FIG. 16 is a cross-sectional view along the lines A-A of FIG. 15.
Figure 17:
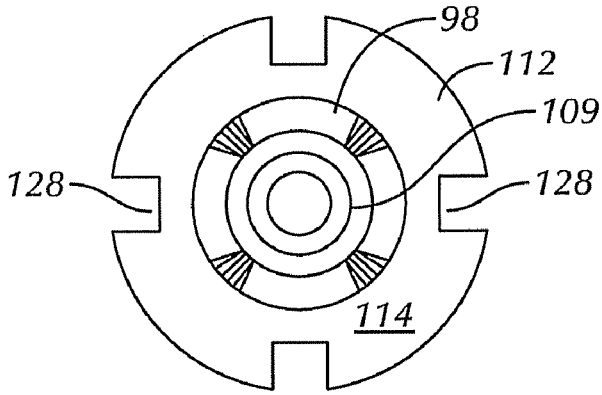
FIG. 17 is a bottom view of the plate member of FIG. 15.

The plate member P includes a generally circular upper plate or disk 112 (FIGS. 15, 16 and 17) below which the skirt 102 and guide surface 98 are formed. The upper plate or disk 112 of plate member rests along a lower surface 114 on upper top wall 116 above a side wall 117 of the housing H. The plate member P has an internal sleeve 118 which is fitted over the shaft T to permit rotational movement of the shaft T with respect to the plate member P.

Figure 18:
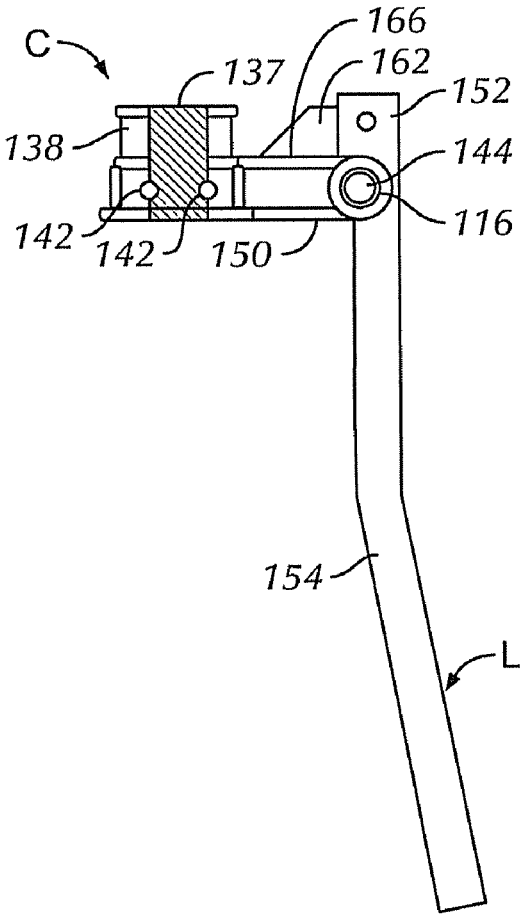
FIG. 18 is an elevation view, taken partly in cross-section, of a cap member and control lever of the switch stand of FIG. 3.
Figure 19:
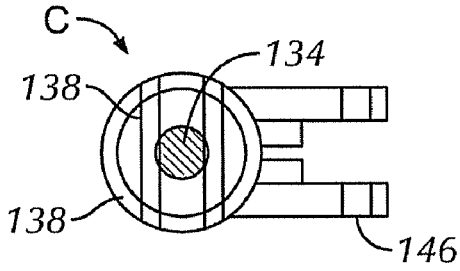
FIG. 19 is a horizontal cross-sectional view of a portion of the structure of FIG. 18.

The shaft T is freely rotatable about its longitudinal axis with respect to the plate member P and a bearing 120 is located between the shaft and plate member to allow such rotational movement. The bearing 120 also reduces friction during manual operation of the switch stand S. The bearing 120 is fitted in a chamber or socket within a raised lip or rim 124 on an upper surface 126 of the plate member P. The plate member P also has a suitable number of spaced detents 128 formed on an outer rim or edge 130 of the upper plate disk 112. The detents 128 are adapted to receive and engage a control lever L mounted with a top cap C (FIGS. 3, 4 and 18).

Figure 11:
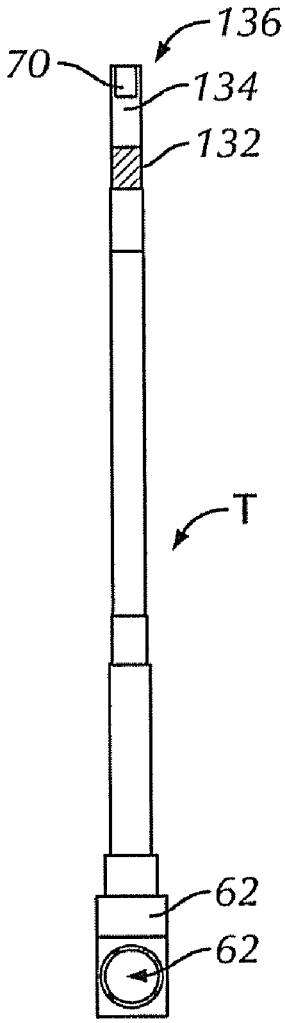
FIG. 11 is a side elevation of the shaft of the switch stand of FIG. 3.
Figure 12:
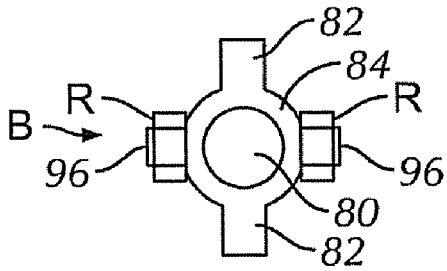
FIG. 12 is a plan view of a contact block of the switch stand of FIG. 3.
Figure 13:
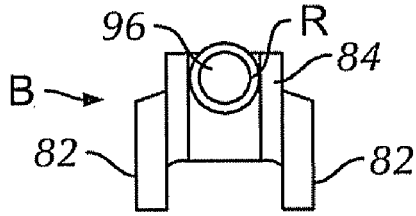
FIGS. 13 and 14 are side elevation views of the contact block of FIG. 12.
Figure 14:
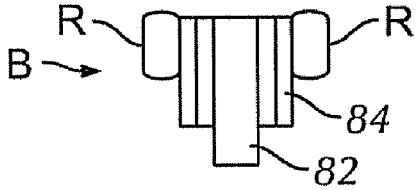

The top cap C is fitted onto the shaft T and is lowered to a position adjacent a threaded outer surface 132 (FIG. 11) formed on an upper portion 134 of the shaft T adjacent an upper end 136. The top cap C has a threaded inner surface 137 formed in an upper sleeve 138. The threaded inner surface 136 is mated to the threaded surface 134 of the shaft T. The cap C is assembled onto the shaft T by rotational engagement of the threaded surfaces 134 and 136 and thus is fixedly mountable with the shaft T for rotational movement therewith. The dimensions and extent of the threaded surfaces 134 and 136 are such that the spring 100 is compressed to the desired force level when the threaded connection is fully made. Lateral ports 142 are formed in the sleeve 138 of the cap C extending through the sleeve 138 for insertion of connector dowels or pins to lock the shaft T with the cap C after the threaded surfaces 134 and 136 are rotated into engagement with each other.

A control lever L is pivotally mounted at connector pins 144 in sockets 146 formed on an outer edge portion 150 of the cap C. The control lever L includes an inner end portion 152 inwardly from the pivotal connection with the cap C and a lower arm or grip portion 154 extending outwardly form such pivotal connection. The arm 154 of the control lever L is adapted to be fitted into firm fitting and locking engagement when in a lowered position as shown in the drawings (FIG. 3) in a selected one of the detents 128 in order to interconnect the shaft T and the plate member P for concurrent movement. Thus there is no need for provision of a separate locking device or mechanism to lock the control lever L to the plate member P in the switch stand S.

The control lever L is also pivotally movable with respect to the cap C when in an unlocked position so that the inner end portion 152 is fitted within a set of upwardly extending lugs 162 formed on an upper surface 166 of the cap C. In this position, the force of the spring 100 does not act on the shaft T since the plate member P and the cap C are not interconnected. A crew member can then rotate the shaft T and cap C using the lever L and manually change the position of the switch points 46 and 48 through the linkage provided by the connecting rod 50. Because the force of the spring 100 is not exerted on the shaft T at this time, relatively little force is needed. When the position of the switch points has been changed, the control lever L is then pivoted into the locking position as shown in FIG. 3 and the switch W is locked in the new position.

Figure 20:
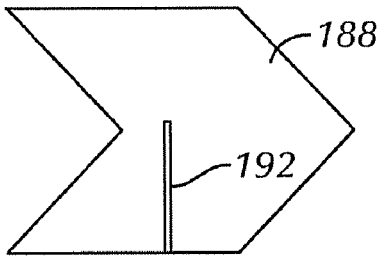
FIGS. 20 and 21 are side elevation views of indicator panels of a switch stand according to the present invention.
Figure 21:
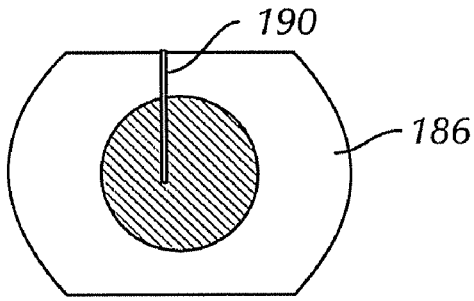

The top cap member C has a socket or cup 170 (FIG. 11) formed in the upper portion 136 with a threaded inner portion to receive a threaded lower end 174 (FIGS. 3 and 4) of an indicator shaft or pole 176. The indicator shaft 176 extends to an outer or upper end 178 which has a connector sleeve 180 mounted thereon. The connector sleeve 180 has connector ports or sockets 182 formed therein at suitable positions to receive connector pins or screws 184 and connect indicator panels or displays 186 and 188 which indicate the setting or position of the switch W. The indicator panels 186 and 188 have mating fitting notches 190 and 192 (FIGS. 20 and 21) formed in them to allow the panels 186 and 188 to be interconnected at positions transverses to or intersecting each other.

As shown in the drawings, the panel 186 is of a generally rectangular shape, rounded at the corners and bearing thereon suitable indicator information, typically of a reflective material. The panel 188 is of the conventional arrow shape. The width of the fitting slots or notches 190 and 192 corresponds to the thickness of the panels 186 and 188. Each of panels 186 and 188 has connector ports or holes for passage of connector screws or pins to attach such plate to the connector sleeve 180. The sleeve 180 has a hole or socket at a lower end that connects with close tolerance with an upper end of the indicator shaft 176. The connections between the sleeve 180 to the indicator shaft 176, and of indicator shaft 176 to the shaft T, are secured by connector pins or other suitable fasteners or connectors.

In manual operation of the switch stand S of the present invention, the control lever L is unlocked and lifted out of the detent 128 in the plate member P in which it is currently located. A railroad service crew member can then using the lever L change the position of the shaft S and switch points 46 and 48, as has been described. The cap member C with its connections at dowel pins in ports 142 is interconnected with the shaft T and movement from the lever L is transferred to the shaft T. The indicator panels 186 and 188 rotate with the shaft T and indicate the new setting or position of the switch W.

The plate member P with bearings 70, 72 and 120 allows such rotation to occur without requiring the resilient force exerted by spring 100 on the switch W by locked switch stand S to be overcome. The contact block B with its central passage 80 around the shaft T allows rotation of the shaft T to occur with respect to the housing H.

In a trailing operation, the switch W and switch stand S are in a locked or set position with the switch points 46 and 48 in the set or normal position allowing traffic onto the straight track (FIG. 1) as is customary. When required to permit rolling stock to transfer from rails 42 and 44 through the switch W onto rails 32 and 34, with the switch stand of the present invention, the switch stand S does not have to be manually unlocked to allow trailing operations to occur. The control lever L remains in the locked position in the plate member P and the shaft T and plate member P are interconnected for concurrent movement.

When wheels of rolling stock on the rails 42 and 44 contact the switch points 46 and 48, the force exerted is sufficient to overcome the force of the spring 100 and allow the shaft T to rotate. The contact block B with its roller members R allows the camming surface 98 of the plate members P to move over the roller members R. Accordingly, the shaft T and switch points 46 and 48 move from the set position to allow passage of the rolling stock through the locked switch W.

The cap member C with its threaded engagement at surface 136 to the shaft T can be gradually unthreaded and released in order to slowly release the compressive force in the spring 100 when maintenance of the switch stand S is necessary. The connector pins in ports 142 are first removed. The cap member is then unthreaded from the shaft T. The dimensions of the threaded connection surfaces are such that when the unthreading is completed, the compressive forces of the spring 100 are also released. This is a simple mechanical operation, no great level of experience, training or skill is required. In addition no special tool to counter the force of the compressed spring 100 is required.

Figure 22:
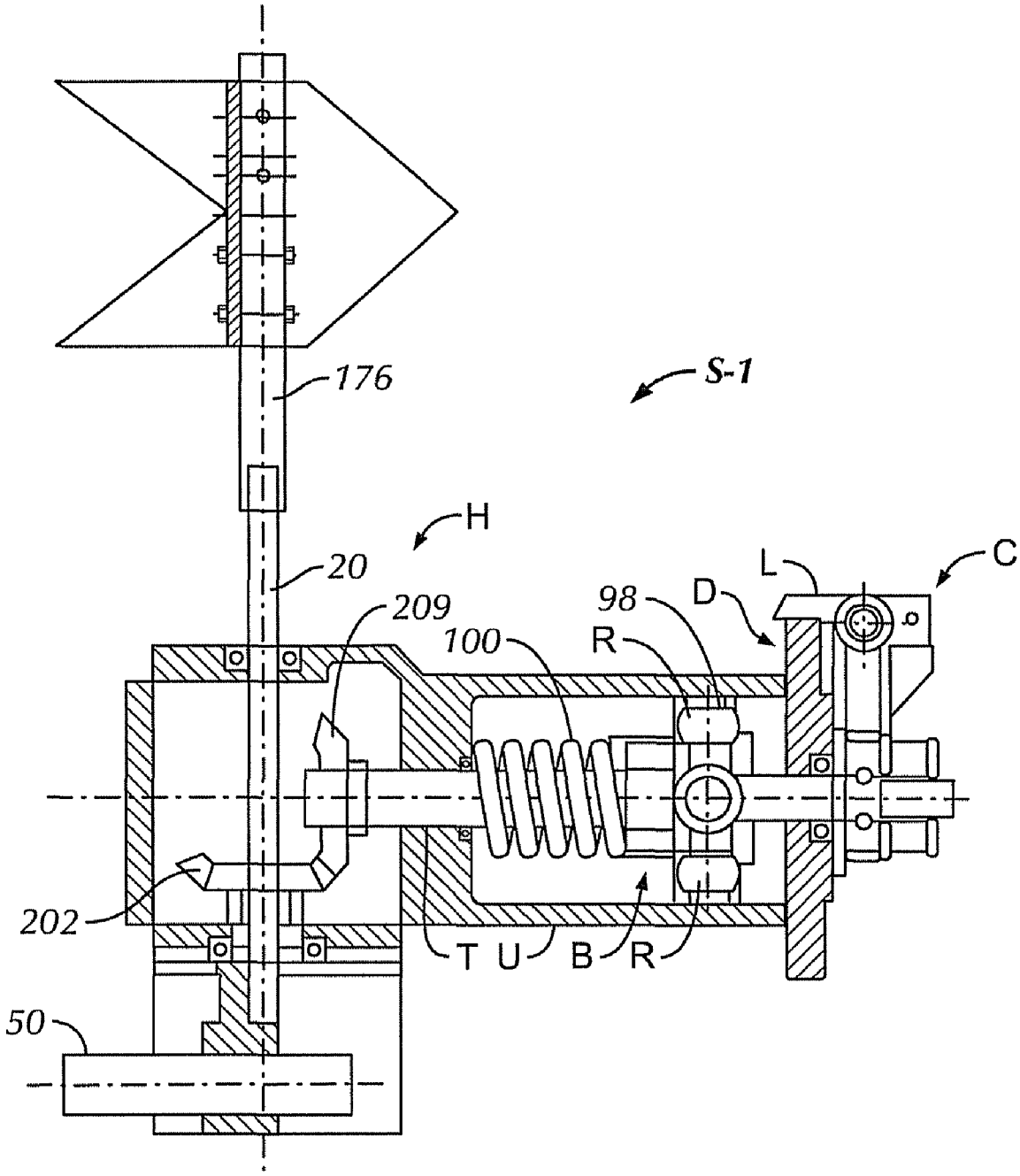
FIG. 22 is a side elevation view, taken partly in cross-section, of an alternate embodiment, a low switch stand, according to the present invention.

The switch stand S (FIGS. 3 and 4) is what can be termed a high or tall switch stand. It should be understood that switch stands according to the present invention may take the form of a low switch stand such as that shown as the switch stand S-1 (FIG. 22). For any of several reasons, low switch stands may be required or used at locations where inadequate clearance or space is available for a high switch stand.

In the switch stand S-1, like structure to that of the switch stand S bears like reference numerals or indicator letters. The switch stand S-1 includes a cap member C threaded onto a shaft T to cause a compressive force in a spring 100 in a like manner to the structure of FIGS. 3 and 4. The switch stand S-1 also includes a control lever L pivotally mounted on the cap member as is shown in FIG. 3. The control lever L is locked into a detent in the plate member P, and the plate member has a camming surface 98 engaging guide rollers R on block member B. This structure permits trailing operations of the switch W in the switch stand S-1 in a like manner to the switch stand S, as previously described.

In the switch stand S-1, the shaft T extends laterally or generally horizontally in a parallel plane to the surface on which the switch W and its associated track are positioned, rather than upwardly or vertically as is the case with the stand S. The shaft T in the switch stand S-1 is connected by bevel gears 202 and 204 to a rotatable transfer shaft 206 connected at its lower end by a pivot eye to the connecting rod 50. Thus the shaft T is operably interconnected to the switch W for corresponding movement in the manner described above for the switch stand S. The switch stand S-1 allows manual operation of the switch W to change position in the manner previously described, while also allowing trailing operations while locked.

The indicator shaft 176 of the switch stand S-1 is coaxially connected to the transfer shaft 206 to allow corresponding rotation of the shaft 176 and the shafts T and 206 to indicate the position or setting of the switch W.

Due to permitting trailing operations while the switch W is locked by engagement of the control lever in the plate member P, the modular switch stands S and S-1 save being forced to make stops to unlock the switch stand for trailing operations. The effort for moving the switch points and temporarily allowing passage of rolling stock through the switch W is made by the effect of the rolling stock wheels and the train need not stop at the switch. Fuel consumption is reduced since a locomotive may continue at its desired and need not use additional fuel due to frequent stops and starts for switch manual switch adjustment for the purpose of allowing trailing operations.

With the capability of permitting trailing while the switch W is otherwise set for allowing through operation, the modular switch stands of the present invention do not need a padlock to keep the switch point in engagement with side rails. The control lever L is inserted and fitted into a slot or detent 128 of the plate member P for this purpose. The spring 100 in the housing H exerts the required pressure of the switch point 48 on the side rail 44.

The switch stands according to the present invention with provision for trailing operations in the manner described are no larger than conventional types of manual switch stands. The location of the trailing mechanism inside the switch stand does not result in an increased profile height for the switch. It also does not hamper or interfere with other desired switch stand functions.

In addition to yard switching operations, a modular switch stand according to the present invention with its incorporated trailing mechanism can be used for main line and transit operations, such as in situations where trailing is not required or is not frequently used. The trailing mechanism according to the present invention is built into and integral with the switch stand and does not require that it be a separate unit from the switch stand at or near the throw bar. Further, maintenance and inspection is not difficult since the switch stand can be easily disassembled on site for access to inspect and service or replace the trailing mechanism within the switch stand.

Having described the invention above, various modifications of the techniques, procedures, material and equipment will be apparent to those in the art. It is intended that all such variations within the scope and spirit of the present invention as defined in the appended claims be embraced thereby.

What is claimed is:

1. A switch stand for operating a railroad switch in a trailing operation, moving points of the railroad switch from a set position to permit passage of railroad rolling stock through the switch in the trailing operation, the switch stand comprising:

a housing mounted adjacent the railroad switch;

a shaft mounted in the housing and connected to the railroad switch, the shaft being rotatable to permit movement of the railroad switch when the switch is contacted by a wheel of the rolling stock in a trailing operation;

a contact block member mounted in the housing with the shaft, the contact block member moving along a longitudinal axis of the shaft, but being restrained against rotational movement with respect to the shaft and housing as the shaft rotates;

a guide roller member rotatably mounted on the contact block member;

a plate member fixedly mountable with the shaft for rotational movement therewith to cause rotational movement of the shaft with respect to the housing in response to movement of the railroad switch when the switch is contacted by a wheel of the rolling stock in a trailing operation;

the plate member having a camming surface along a portion thereof engaging the guide roller member;

the plate member further having locking detents formed therein;

a resilient member located in the housing below the contact block member, the resilient member urging the guide roller member against the camming surface of the plate member, the resilient member exerting force on the plate member to return the plate member to a position causing the switch to return to the normal position on removal of contact of the rolling stock wheel against the switch;

a cap mounted with the shaft for rotational movement therewith and having control detents formed therein; and a control lever mounted with the cap and selectively movable into engagement with one of the control detents in the cap to interconnect the shaft and the cap and allow rotational movement thereof during trailing operation of the switch stand.

2. The switch stand of claim 1, further including:

the resilient member yielding to force from contact of the rolling stock wheel against the switch to allow movement of the switch points in the trailing operation.

3. The switch stand of claim 1, wherein the housing extends upwardly from the railroad switch.

4. The switch stand of claim 1, wherein the housing extends laterally away from the railroad switch.

5. The switch stand of claim 1, wherein:

the cap has a threaded surface along an internal sleeve formed therein;

the shaft has a threaded surface along a portion of its length; and the threaded surfaces of the cap and the shaft engaging to lock the cap and the shaft.

6. The switch stand of claim 5, wherein the resilient member is located in the housing below the contact block member, the resilient member being compressed on engagement of the cap onto the shaft.

7. The switch stand of claim 1, wherein:

the contact block member has outwardly extending guide fingers formed thereon; and the housing has guide channels formed on inner side walls thereof to receive the guide finger members of the contact block member.

8. The switch stand of claim 1, further including:

an indicator shaft extending upwardly from the shaft;

indicator panels mounted with the indicator shaft for indicating the position of the railroad switch.

9. The switch stand of claim 1, wherein the control block member is movable from engagement with the plate member to allow manual change of the position of the switch.

10. The switch stand of claim 1, wherein the housing includes:

an upper housing containing the contact block member therein;

a lower housing for mounting to support structure of the railroad switch;

the upper housing and the lower housing being removably connected to each other.

11. The switch stand of claim 1, wherein the plate member is movable with respect to the housing during rotation of the shaft and plate member.

12. The switch stand of claim 1, wherein the guide roller member is mounted for rotational movement on shafts extending outwardly from the contact block member.

13. The switch stand of claim 1, wherein camming surface includes a rest position for receiving the guide roller member in the absence of contact of the rolling stock wheel against the switch.

14. The switch stand of claim 1, wherein camming surface includes contoured surfaces extending away from the rest position to allow rotation of the plate member and shaft with respect to the housing in the presence of contact of the rolling stock wheel against the switch.

15. A switch stand for operating a railroad switch in a trailing operation, moving points of the railroad switch from a set position to permit passage of railroad rolling stock through the switch in the trailing operation, the switch stand comprising:

a housing mounted adjacent the railroad switch;

a shaft mounted in the housing and connected to the railroad switch, the shaft being rotatable to permit movement of the railroad switch when the switch is contacted by a wheel of the rolling stock in a trailing operation, the shaft having a threaded surface along a portion of its length;

a contact block member mounted in the housing with the shaft, the contact block member moving along a longitudinal axis of the shaft, but being restrained against rotational movement with respect to the shaft and housing as the shaft rotates;

a guide roller member rotatably mounted on the contact block member;

a plate member fixedly mountable with the shaft for rotational movement therewith to cause rotational movement of the shaft with respect to the housing in response to movement of the railroad switch when the switch is contacted by a wheel of the rolling stock in a trailing operation;

the plate member having a camming surface along a portion thereof engaging the guide roller member;

the plate member further having locking detents formed therein;

a resilient member urging the guide roller member against the camming surface of the plate member, the resilient member exerting force on the plate member to return the plate member to a position causing the switch to return to the normal position on removal of contact of the rolling stock wheel against the switch;

a cap mounted with the shaft for rotational movement therewith and having control detents formed therein, the cap having a threaded surface along a portion of its length;

the threaded surfaces of the cap and the shaft engaging to lock the cap and the shaft; and a control lever mounted with the cap and selectively movable into engagement with one of the control detents in the cap to interconnect the shaft and the cap and allow rotational movement thereof during trailing operation of the switch stand.

16. The switch stand of claim 15, wherein the resilient member is located in the housing below the contact block member, the resilient member being compressed on engagement of the cap onto the shaft.

* * * * *